United States Patent [19]

Porter

[11] Patent Number: 4,787,327

[45] Date of Patent: Nov. 29, 1988

[54] LIFT FOR MARINE CRAFT

[76] Inventor: Glenn A. Porter, c/o BTM Industries, Inc., 604 Washington, Woodstock, Ill. 60098

[21] Appl. No.: 19,437

[22] Filed: Feb. 26, 1987

[51] Int. Cl.[4] ..... B63C 7/16

[52] U.S. Cl. ..... 114/44; 405/3; 414/678

[58] Field of Search ..... 114/44–46, 114/344, 230; 405/1, 3, 4, 5, 6, 7; 280/414.1; 414/678, 917

[56] References Cited

U.S. PATENT DOCUMENTS

| | | | |
|---|---|---|---|
| 2,585,664 | 2/1952 | Le May et al. . | |
| 2,963,176 | 12/1960 | Smith . | |
| 3,021,965 | 2/1962 | Harvey . | |
| 3,083,540 | 4/1963 | Smith . | |
| 3,220,196 | 11/1965 | Schollard | 405/1 |
| 3,227,292 | 1/1966 | Jacobs | 414/678 |
| 3,275,167 | 9/1966 | Godbersen . | |
| 3,753,355 | 8/1973 | Knoch . | |
| 4,019,212 | 4/1977 | Downer . | |
| 4,022,027 | 5/1977 | Tetzner | 405/3 |
| 4,027,492 | 6/1977 | Carpenter | 405/3 |
| 4,072,119 | 2/1978 | Williams . | |
| 4,318,632 | 3/1982 | Fortmeyer . | |
| 4,469,346 | 9/1984 | Low | 280/414.1 |
| 4,595,313 | 6/1986 | Kotke | 414/678 |

FOREIGN PATENT DOCUMENTS

| | | | |
|---|---|---|---|
| 2460838 | 3/1981 | France | 405/1 |

*Primary Examiner*—Galen Barefoot
*Assistant Examiner*—Paul E. Salmon
*Attorney, Agent, or Firm*—Wood, Dalton, Phillips, Mason & Rowe

[57] ABSTRACT

According to the invention, a lift is provided having base beams, first and second pairs of lifting arms and lifting rails. The lifting arms have one end pivotally mounted to the base beams for rotation about parallel axes with the common plane of the axes residing substantially in a horizontal orientation. The other ends of the lifting arms pivotally connect to the lifting rails to define, when viewed from the side, a closed linkage that permits the lifting rails to be raised and lowered relative to the base upon the lifting arms being simultaneously pivoted. The bow pair of lifting arms are longer than the stern pair of lifting arms, and the distance between the pivots on the base beams is greater than the distance between the pivots on the rails so that the linkage cannot lock-up when in the loading position and so that a craft resting on the rails is inclined with the bow above the stern for drainage. A cross bar defining one pivot center is engaged by the bottom of the rails when the lift is in the loading position whereby the box lifting arms form an angle with the beams that not only prevents the linkage from locking up but also minimizes the initial lifting force needed to raise the rails and a boat docked thereon.

22 Claims, 1 Drawing Sheet

FIG. 1
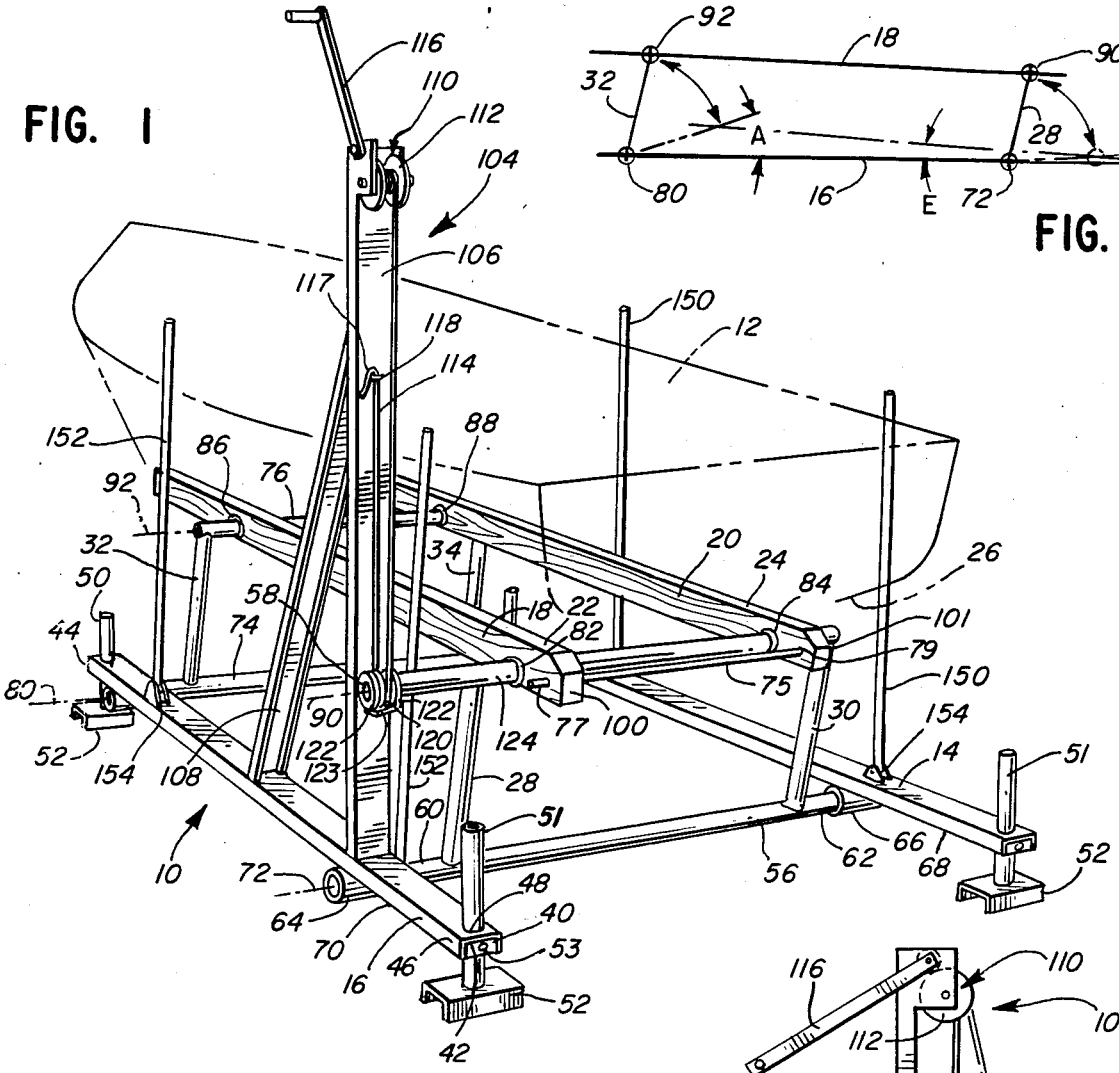
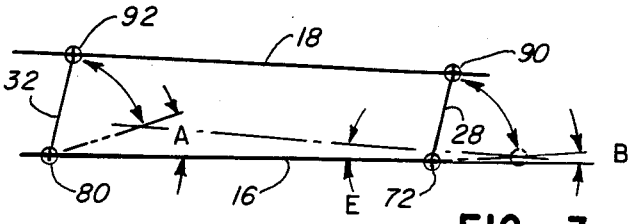
FIG. 3
FIG. 2
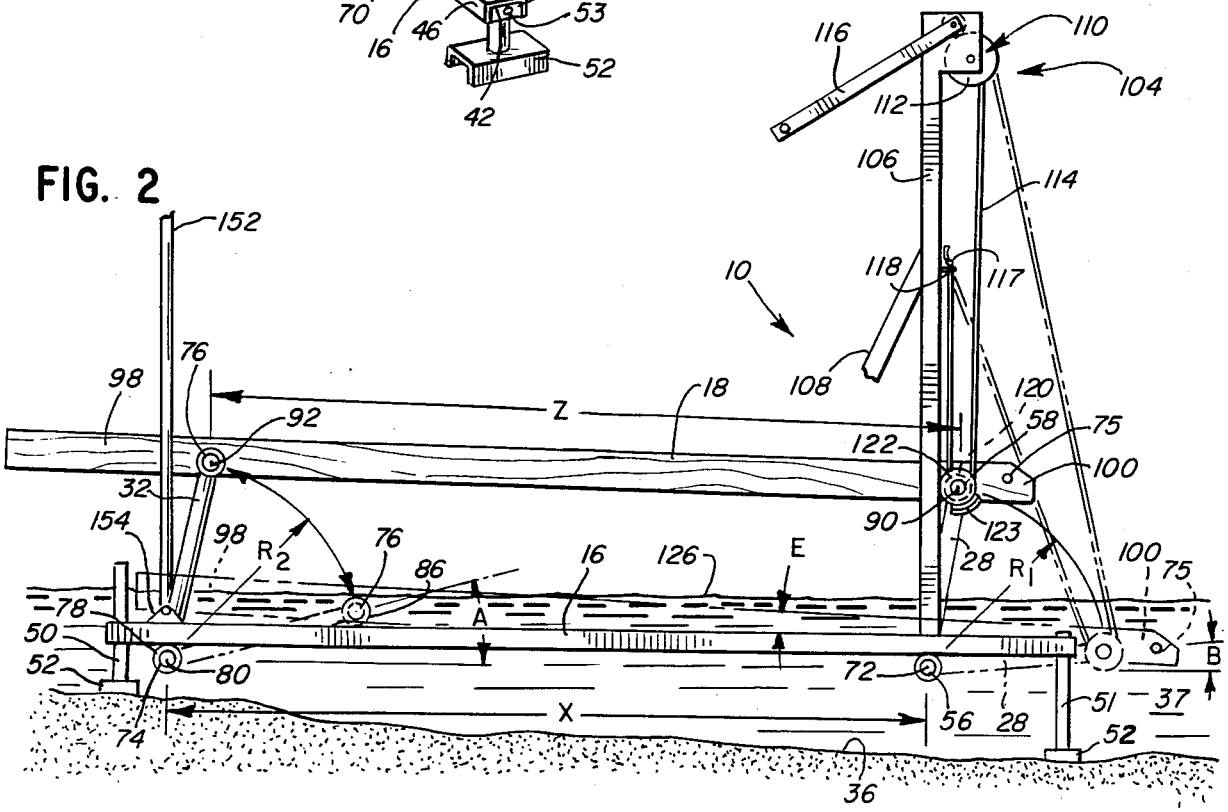

LIFT FOR MARINE CRAFT

BACKGROUND OF THE INVENTION

Field of the Invention

This invention relates to structure for hoisting marine craft out of water and, more particularly, to a light weight linkage structure for efficiently lifting a craft and for supporting the craft in an inclined orientation.

Background Art

Marine craft are preferably stored out of water to prevent accumulation of marine life on and deterioration of the submerged portion of the craft hull. Further, it is difficult to secure a craft that is in rough waters which may pound against its mooring and damage the hull. Newer style water craft such as the small sized motorized marine craft are not particularly stable in rough water and in a non-moving standing position and, therefore, of necessity should be stored out of the water. The above reasons warrant the removal of the craft from the water after each use, regardless of the frequency of use. It is therefore desirable to have available a sturdy support through which placement of a craft in, and removal of the craft from, the water can be accomplished quickly and with minimal effort.

An exemplary prior art structure is shown and described in U.S. Pat. No. 4,019,212, to Downer. In Downer, two lifting arms are pivotally attached to an upright frame and carry a lift bed which engages the underside of a boat hull for supporting the boat when in an elevated position.

A structure such as that in Downer has numerous drawbacks. First of all, the lifting arms at all times maintain the boat in a horizontal orientation. Water that has accumulated within the boat will not flow towards a drain port normally provided in the stern portion of the hull bottom or transom and, therefore must be manually bailed out. The only way that Downer could tilt the boat to utilize the drain port would be to incline his base which rests on the bottom of the lake, thereby compromising the stability of the entire structure.

Another problem with the Downer structure is that there is no provision made to keep the bed with associated lifting arms from sinking in the water. If the cable is inadvertently slackened, movement of the lifting arms is unrestrained and they may pivot in a clockwise direction in FIG. 1 to the point that the linkage goes over center and must be manually reoriented.

Many known prior art structures use a parallel organ-type linkage with the pairs of lifting arms being equal in length and the base beams and lifting rails also being equal in length. Such a structure is shown in FIGS. 9–11 of U.S. Pat. No. 2,585,664 to LeMay et al where stop members 78, 79 are required to prevent the lifting arms from being lowered to a point where they would lock up and be incapable of lifting the boat. Due to the stops, the LeMay et al rails are considerably above the lake bottom which creates two additional problems, one being the fact that the lift has to be in deep water in order for the rails to be low enough to permit a boat to ride onto the rails for lifting and, second, the entry end of rails extend out beyond the stern pads 13 so that a boat with a motor will have its center of gravity over the unsupported end of the rails which will tip the lift before the boat can be lifted.

Additionally, it may be difficult to consistently position the craft lengthwise along the bed. The result being that the boat is not properly balanced on the bed and there may be a tendency of the entire structure to shift or tip on the lake bottom under the unbalanced load. The Downer structure along with other known structures are extremely heavy, are in many cases, extremely cumbersome, and are almost impossible for two men, let alone one man, to lift and maneuver into position in the water.

All of the above deficiences detract from the desirability of using the boat lift of Downer or of LeMay et al on a frequent basis. The present invention is specifically directed to overcoming these problems in a novel and simple manner.

SUMMARY OF THE INVENTION

According to the invention, a lift is provided having a base with beams, first and second lifting arms and lifting rails. Each pair of lifting arms have one end fixed to cross bars which are pivotally mounted to the base beams for rotation about parallel axes with the common plane of the parallel axes residing substantially in a horizontal orientation. The other ends of the lifting arms are fixed to cross bars which are pivotally connected to the lifting rails to define, when viewed from the sides, a closed linkage that permits the lifting rails to be raised and lowered relative to the base beams upon the cross bar between the stern pair of lifting arms and the lifting rails, being raised or lowered.

The length of the bow pair of lifting arms is calculated with respect to the stern pair of lifting arms such that a craft resting on the lifting rails is inclined from the bow toward the stern. With the boat inclined, a drain port, normally located in the stern of the boat, can be used to drain water under the force of gravity. The space between the bow cross bar pivot and the stern cross bar pivot on the lifting rails may be shorter than, equal to or greater than the space between the cross bar pivots on the base which length combines with the different lengths of the lifting arms to further angle the lifting rails front to rear at the water level not only to aid in loading the boat on the lift but also to aid in reducing the force needed to start the lifting of the boat from the water. With the bow lifting arms longer than the stern lifting arms and with the spacing between the pivot axes on the beams and the pivot axes on the rails being different a trapezium is defined. With the lifting rails angled downward from bow to stern the curved box part of the boat will make initial contact with the lifting rails which will tilt the bow of the boat higher. The increased tilt of the boat will position the boat with the center of gravity between the bow and stern pads contacting the lake bottom.

Preferably, two, spaced lifting rails are provided and are aligned lengthwise of the boat on opposite sides of the boat keel. By making the rails out of wood or other buoyant material and by the geometry created by the different lengths of the components of the linkage, the rails can be lowered into the water so that the stern ends are submerged and the bow ends project slightly above the water level. The projecting portions of the rails together with upstanding guide poles afford a consistent frame of reference to thereby guide the boat into centered relationship both laterally and lengthwise on the rails. Further the floating rails along with the different length of lifting arms and the different lengths of the space betwen the cross bar pivots on the lifting rails and on the base prevent overpivoting of the arms, which overpivoting could lock up the linkage thereby requiring manual repositioning of the linkage. A bumper bar is provided between the lifting rails at the stern end of the lift against which the motor of a boat may abut when the boat is fully on the lift.

Still further, as the rails are lifted by means of a cable and hoist apparatus, the weight is placed on the base and on the pads on the lake bottom to firmly plant the light weight apparatus and to reduce or to eliminate tipping and shifting of the apparatus. The apparatus is relatively light in weight such that one person standing between the lifting rails can raise the apparatus and maneuver it into or out of the water or to reposition it in the water.

BRIEF DESCRIPTION OF THE DRAWINGS

FIG. 1 is a perspective view of a marine craft lift according to the present invention with a boat carried thereon in an elevated position;

FIG. 2 is a side elevation view of the lift in FIG. 1; and

FIG. 3 is a schematic view of the relative lengths of the components of one preferred form of the invention showing the relative locations of the pivots in the raised and lowered positions.

DETAILED DESCRIPTION OF THE DRAWINGS

In FIGS. 1 and 2, a marine craft lift apparatus according to the present invention is shown at 10, and in FIG. 1 a water craft or boat 12 is shown in phantom resting atop the boat lift in an elevated position. The invention contemplates use with any smaller type of marine craft but has particular application with small sized motorized marine craft, row boats, small outboard boats and the like. The structure can be used for storage of water craft over a body of water or on dry land, as desired.

The boat lift 10 comprises spaced, elongate base beams 14, 16 and a movable cradle consisting of spaced lifting rails 18, 20, with upwardly facing surfaces 22, 24 for bearing on the undeside 26 of the hull of the boat 12, a first pair of stern or rear lifting arms 28, 30 and a second pair of bow or forward lifting arms 32, 34.

The base beams 14, 16 in FIG. 2 are placed in a body of water such as a lake 37 and are preferably constructed from channel-shaped stock with a downwardly opening U-shape in cross-section. Each beam has the same general construction and one beam 16 will be described for illustration purposes. Blocks 40 are fit within the U-shaped beam opening 42 and are fixed to the beam at the bow end 44 and stern end 46 respectively. Blocks 40 have a vertical bore 48 to slidably or threadably accept either a bow leg 50 or a stern leg 51 having fixed channel pads 52 at the bottom ends which channel pads imbed in the lake bottom and act as anchors to keep the lift aparatus from shifting while the boat is being docked and raised. Each leg 50, 51 is slidable or threaded within its respective block 40 to adjust its extension below the beam 16. A set screw 53 or other locking means is positioned in each block to fix the position, the extension of the leg 50, 51 below the beam. Through the adjustable legs 50, 51 associated with each end portion of each beam 16, 18, the beams 16, 18 can be horizontally positioned and generally levelled with respect to each other on an irregular lake bottom surface 36 such as that shown in FIG. 2.

The stern lifting arms 28, 30 are rigidly connected at one end to a cross bar 56 and at the other end to a cross bar 58 so that when viewed from the stern end of the lift the cross bars 56, 58 and arms 28, 30 form a rectangle. The cross bar 56 has opposite ends 60, 62 extending laterally beyond the arms 28, 30, for reception in axially aligned bushings nested in bushing blocks 64, 66, respectively, which bushing blocks are fixed to the underside 68, 70 of the beams 14, 16 so that the cross bar 56 pivots about a laterally extending axis 72 beneath the beams 14, 16. The lifting arms 28, 30 are spaced from each other so that they reside between and are spaced laterally inwardly from the beams 14, 16.

The bow lifting arms 32, 34 are rigidly connected at one end to a cross bar 74 and at the other end to a cross bar 76 with extensions of the cross bar 74 journaled for rotation within bushings in bushing blocks 78 (one shown) fixed to the undersides 68, 70 of beams 14, 16 for rotation about an axis 80 that is parallel to and spaced from the axis 72.

The pivot axes 72 and 80 are spaced inward from the bow legs 50 and stern legs 51. The cross bar 56 is spaced from the ends of the beams 14, 16 and stern legs 50 by an amount less than the length of the lfiting arms 28, 30 so that the cross bar 58 will clear the end of the beams 14, 16 when the lift is lowered for a reason that will become clear hereinafter.

The upper cross bars 58, 76 extend through openings in the spaced lifting rails 18, 20 and rotate relative to the lifting rails. To prevent shifting of the rails along the axes of the cross bars 58, 76, pairs of collars 82, 84, 86, 88 are fixedly secured to the cross bars closely adjacent the opposite sides of each lifting rail. Similar structure can be provided on the cross bars 56, 74 to fix the lateral location of the beams 14, 16 on the cross bars 56, 74. A bar 75 is fixed in openings 77, 79 through the projecting stern end portions 100, 101, respectively, of the lifting rails 18, 20. The bar 75 serves as a bumper bar to contact the motor of a boat, assuming the boat has an outboard motor, to indicate that the boat is fully seated on the lift.

The cross bar 58 has an axis 90 that is parallel to the axes 72, 80. The cross bar 76 has an axis 92 that is parallel to the axes 72, 80, 90. The lifting arms 28, 30 rotate with the cross bars 56, 58 about the axes 72 on the beams 14, 16 and 90 on the rails 18, 20 and the lifting arms 32, 34 rotate with the cross bars 74, 76 about the axes 80 on the beams 14, 16 and 92 on the rails 18, 20. When viewed from the side as shown in FIG. 2, the rails 18, 20, beams 14, 16 and lifting arm pairs 28, 30 and 32, 34 define a closed linkage.

In one preferred form described above the rails, arms and beams between the four pivots define a trapezium wherein no two sides are parallel and no two sides are equal in length.

The invention contemplates varying the spacings between selected corners (axes 72, 80, 90, 92) of the linkage so as to provide new and unexpected results. First, the distance between pivot axes 72, 90 for the stern lifting arms 28, 30 is to be less than the distance between pivot axes 80, 92 for the bow lifting arms 32, 34. Second, the distance between pivot axes 80, 72 on beams 14, 16 is preferably greater than the distance between pivot axes 90, 92 on rails 18, 20 but the distance may be equal to or less than said distance under appropriate circumstance. With the beams 14, 16 in a substantially horizontal plane, i.e. with the common plane of axes 72, 80 in a horizontal orientation, the upper surfaces 22, 24 of the rails 18, 20 respectively, incline from the bow end 98 of the rails to the stern end 100. As a result, when the lift is in the fully raised position the boat seated on the surfaces 22, 24 will cause any water in the boat to move by gravity towards the stern of the boat and can be discharged through a conventional drain port. The incline is determined by the relative length of arms 28, 30 as compared to arms 32, 34 and by the relative spacings between the axes 72, 80 on beams 14, 16 and axes 90, 92 on rails 18, 20.

An important aspect of the invention requires that when the lift is fully lowered, the angle A (between the beam 16 and lifting arm 32) be greater than angle B (between the beam 16 and lifting arm 28) so that the plane of the rails 18, 20 will not lower to a point too close to parallel to the plane of the beams 14, 16. That is, the lengths of the rails 18, 20 between pivots 76 and 58 (i.e. between axes 90, 92) are determined so that with the longer lifting arms 32, 34 as compared with lifting arms 28, 30, the rails can be lowered to a point that the plane of the rails 18, 20 forms an angle E with the plane of the beams 14, 16.

When the lift is in the fully lowered position, the bottom surface of rails 18 & 20 are in contact with and are tangent to cross bar 56 (on axis 72) creating a mechanical stop that prevents the stern lifting arms 28, 30 from assuming angles that would cause the linkage to lock up when lifting begins. Also, when the lift is in its fully lowered position with the rails 18, 20 in contact with cross bar 56, the opposite end portions of cross bar 76 are close to or are spaced upwardly from the top surfaces of the base beams 14, 16. The difference between the lengths of the bow and stern lifting arms and the difference in the spacing between the axes 90, 92 of the pivots on the rails 18, 20 and the spacing between the axes 72, 80 of the pivots on the beams 14, 16 establishes the angle E (FIGS. 2 and 3) between the plane of the beams 14, 16 and the plane of the rails 18, 20 when the lift is in the fully lowered or loading position. As a boat enters the lift, the bow end portion of the boat will first contact the angled lifting rails 18, 20 which will tilt the bow of the boat higher and lower the stern of the boat as the boat continues to move forward on the lift and the center of gravity of the boat moves to a position forward of the axis 90 and between the box legs 50 and the stern legs 51 ready for lifting from the water.

The relative lengths of the bow and stern lifting arms, and the spacings between the pivot axes on the beams and the pivot axes on the rails can be arrived at by trial and error or can be calculated using the following equation.

$$Z=X+R1-R2+V.$$

The following is an exemplary set of dimensions for an operative and successful lift apparatus according to the invention.

EXAMPLE

R1=effective length of stern lifting arms 28, 30=18 inches

R2=effective length of box lifting arms 32, 34=20 inches

X=beam distance between axes 72, 80=66 inches

Z=rail distance between pivot axes 90, 92

E=angle of inclination of rails 18, 20

V=variable which establishes angle E with the lift in a lowered position=½ inch

Accordingly, the rail length Z between pivot axes 90 and 92 is equal to 64½ inches. It is important that angle A between the beams 14, 16 and the lifting arms 32, 34, when in the down position, is larger than angle B between beams 14, 16 and arms 28, 30 so that the force couples created by raising the cross bar 58 will not lock up the linkage and will not prevent raising the boat.

It has been found that for beams 14, 16 having spacings between axis 72 and axis 80 of about 64 inches the variable V is preferably in the range of about ⅜" to ¾" and the angle E between the rails 18, 20 and the beams 14, 16 is in the range of about 1½° to 4°.

To raise and lower the rails 18, 20 a hoist assembly 104 is provided. The hoist assembly comprises an upright post 106 secured to the beam 16 and a brace member 108, which extends angularly between the post 106 and beam 16. A winch 110, which may be a conventional type, is fixed at the top portion of the post 106 and has a rotatable spool 112 which contains a supply of rope or cable 114. The spool 112 is rotated by means of a crank handle or wheel 116 and has a selectively engageable gear and brake apparatus for winding or unwinding cable onto or from the spool.

A free end 117 of the rope or cable 114 is secured to an anchor 118 on the post 106. The cable extends from the anchor around a pulley 120 which is rotatable on a bushing on free end 124 of the cross bar 58. The pulley 120 is retained on the cross bar 58 between two collars 122 affixed to the bar 58 on opposite sides of the pulley. A rope or cable retainer 123 is affixed to one of the collars 122 and overlaps the groove in the pulley to retain the rope or cable on the pulley even when there is slack in the rope or cable. With the lift in the down or loading position (dotted line position of FIG. 2), the crank handle or wheel 116 is turned in the clockwise direction, the rope or cable 114 will be wound onto the spool 112 which effectively shortens the length of the rope or cable between the winch and cross bar 58 so that an upward force is applied to the cross bar 58 and the lifting arms 28, 30 begin to pivot in a counterclockwise direction. Due to the fact that the cross bar 58 is connected not only by lifting arms 28, 30 to the pivoted cross bar 56 on beams 14, 16 but also by lifting rails 18, 20 to cross bar 76 which in turn is connected by lifting arms 32, 34 to the cross bar 74 on beams 14, 16, the force applied by the rope 114 to the cross bar 58 will be split into a vertical lifting component on cross bar 58 and a horizontal component transmitted through rails 18, 20 to the cross bar 76. Initially, the vertical lifting component on cross bar 58 is the larger of the two components and starts lifting the rails and boat out of the water. The center of gravity of the boat is located forward of the cross bar 58 and forward of the legs 51 so that the initial relatively high vertical lifting component will be located where needed and where it will be most effective.

As the rails and boat are raised, and due to the pivot mounting of lifting arms 28, 30 about cross bar 56 more of the force applied by the rope or cable 114 to the cross bar 58 will be transmitted through the rails to cross bar 76 with increasing vertical forces applied to cross bar 76. Also, due to the differences in the lengths of arms 28, 30 and 32, 34 as well as rails 18, 20 and beams 14, 16 the ange E will gradually decrease as the lift approaches its fully raised position. In the example set out above, the angle E will diminish slightly from its starting fully lowered position to its fully raised position. There will still be an angle E at the raised position which will assist in draining the boat and keeping the center of gravity properly located between the pads. The post 106 is engaged by an extended portion 124 of the cross bar 58 to prevent the axis 90 of bar 58 from becoming vertically aligned with axis 72 of bar 56 and for keeping tension on the cable 114. Upon reversely rotating or releasing the spool 112, the lifting rails under the weight of the boat move downwardly as the cross bars 58, 76 and arms 28, 30 and 32, 34 pivot in a clockwise manner to the in water lowered position. The linkage of the lift is such that when the lifting rails are in the raised position even without a boat on the lifting rails, the lifting rails, cross bars 58, 76 and arms 28, 30 and 32, 34 will pivot downward under their own weight to the loading position upon turning the handle or wheel 116 in a counterclockwise direction.

As can be seen, initially as the crank is turned to raise the lift and a boat thereon, the force along the cable 114 is proportioned into two components acting on the bar 58—a large vertical force component and a somewhat smaller horizontal force component acting through the rails 18, 20 to the bar 76 and in turn to the arms 32, 34. The horizontal component from bar 58 to bar 76 is proportioned into two components at bar 76—a horizontal component and a vertical (lifting) component. As the arms 28, 30 are pivoted counterclockwise, the horizontal and vertical force components, respectively, acting first on bar 58 and then on bar 76 will gradually shift so that the forces acting on bars 58 and 76 will be substantially vertical lifting forces as the lift reaches its fully raised position (solid line position of FIG. 2).

Preferably, the rails 18, 20 may be made from wood or other material that is sufficiently buoyant to float in water. As a result of the variable V concept discussed above, the rails when lowered into the water will float in the phantom orientation shown in FIG. 2 with the bow ends 98 projecting above the surface 126 of the water and the stern end 100 submerged. In the fully lowered position lifting rails 18, 20 contact cross bar 56 to prevent the arms 28, 30 from pivoting beyond the FIG. 2 position or overcenter to a point where they will bind. The difference in the spacing between pivot centers 72–80 and 90–92 prevents the pivot centers 72, 80, 90, 92 from becoming aligned in a plane and therefore the linkage cannot bind or lock up. The angle E between the lifting rails 18, 20 and the base beams 14, 16 helps transmit the lifting force from axis 90 of bar 58 to axis 92 of bar 76. With the angle A being greater than angle B (the angle between arms 28, 30 and beams 14, 16) the forces required in the initial lifting cycle will be minimized.

To place a boat on the lift 10, the rails are first lowered into the water where the differences in pivot centers 72–80 and 90–92 locate the rails to the phantom or lowered position in FIG. 2. The boat is then directed so that the keel is centered between the rails and between the four upwardly extending guides 150, 152 adjustably mounted by adjusting brackets 154 on base beams 14, 16, respectively, at the bow and stern portions. The guide 152 on the bow end of beam 16 is forward of bar 76 and guide 152 on the stern end of beam 16 is forward of bar 58. The upwardly sloping ends 98 of the rails give the user a frame of reference to consistently locate the boat in centered relationship both laterally and lengthwise of the rails. The bumper bar 75 engages with the lower unit of the boat motor when the boat is fully forward on the lift in proper position. The buoyant forces of the rails allow the rails to float in a relatively free angular position at the extreme lowered position and as the boat is being maneuvered on the rails, they submerge and tend to stabilize the boat until the lifting action begins. The rails initially contact the bow portion of the boat forward of bar 76 which tilts the bow of the boat higher so that the boat assumes substantially the same angle as the lifting rails. With the boat fully located on the rails (the bumper bar 75 contacting the downwardly projecting portion of the boat motor), the center of gravity of the boat will be forward of the cross bar 58 and between the bow legs 50 and stern legs 51. Due to the tilt of the boat on the rails 18, 20 and the rear mount of the boat engine the center of gravity of the boat before lifting begins will be forward of or relatively close to cross bar 56.

The winch is operated to start raising the boat out of the water. Since the weight or center of gravity of the boat is concentrated initially forward of the leg 51 and relatively close to the cross bar 56 and since the vertical component of the lifting forces from the winch on the cross bar 58 is greatest at the start of the lifting cycle, the whole boat will be raised on the lifting rails with the cross bar 58 bearing the bulk of the lifting forces in raising the concentration of weight at the center of gravity in the stern of the boat. Initially, relatively little weight is born by the bow cross bar 76 and the vertical lifting forces at the cross bar 76 are relatively small due to the design of the lift assembly. As the bottom of the boat and the keel break water, the vertical lifting forces are gradually being more evenly shared by the stern cross bar 58 and the bow cross bar 76 through the lifting rails 18 and 20. With the beams 14, 16 relatively stationary, the differences in the relative lengths of the bow lifting arms 32, 34 and the stern lifting arms 28, 30 and the differences in the spacings between the pivot centers 80, 72 on the beams and the pivot centers 92, 90 on the rails will change the angle of the tilt (angle E) of the rails relative to the beams slightly, however, the tilt will still be there and will cause water in a boat on the rails to drain toward and out the stern of the boat.

The inventive mechanism makes possible a compact size for the lift and use of lightweight materials in construction. Accordingly, the lift is capable of being readily moved from place to place and operated all by one person.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lift for elevating a boat relative to a support surface, said lift comprising:
   - an elongate base beam;
   - means for supporting the base beam on the support surface;
   - a first lifting arm;
   - means mounting one portion of the first lifting arm for pivoting movement relative to the base beam about a first axis that is transverse to the length of the base beam;
   - a second lifting arm;
   - means mounting one portion of the second lifting arm for pivoting movement relative to the base beam about a second axis that is parallel to said first axis and spaced lengthwise of the base beam from the first axis;
   - a lifting rail having a boat engaging surface;
   - means mounting a second portion of the first lifting arm to the lifting rail for pivoting movement relative to the lifting rail about a third axis that is parallel to and spaced from said first axis; and means mounting a second portion of the second lifting arm to the lifting rail for pivoting movement relative to the lifting rail about a fourth axis that is parallel to and spaced from said second axis, said first and third axes residing in a first plane, said third and fourth axes residing in a second plane, said second and fourth axes residing in a third plane and the first and second axes reside in a fourth plane, said first, second, third and fourth planes cooperatively enclosing a trapezium, whereby with the fourth plane within which the first and second axes reside horizontally oriented, the second plane within which the third and fourth axes reside is non-horizontal and tilts downwardly from the third axis toward the fourth axis.

2. The lift for elevating a boat according to claim 1 wherein means are provided on said base beam for varying the orientation of said base beam relative to a bearing surface on which said lift and boat are carried.

3. A lift for elevating a boat relative to a support surface, said lift comprising:

an elongate base beam;

means for supporting the base beam on the support surface;

a first lifting arm;

means mounting one portion of the first lifting arm for pivoting movement relative to the base beam about a first axis that is transverse to the length of the base beam;

a second lifting arm;

means mounting one portion of the second lifting arm for pivoting movement relative to the base beam about a second axis that is parallel to said first axis and spaced lengthwise of the base beam from the first axis;

a lifting rail having a boat engaging surface;

means mounting a second portion of the first lifting arm to the lifting rail for pivoting movement relative to the lifting rail about a third axis that is parallel to and spaced from said first axis; and means mounting a second portion of the second lifting arm to the lifting rail for pivoting movement relative to the lifting rail about a fourth axis that is parallel to and spaced from said first axis;

the spacing between the first and third axes being greater than the spacing between the second and fourth axes, whereby with a plane within which the first and second axes reside horizontally oriented, the boat engaging surface is inclined so that a boat placed thereon will be in a tilted position, wherein said third and fourth axes are spaced apart a less distance than are the first and second axes which space difference combines with the space difference between the first and third axes and the second and fourth axes to facilitate raising and lowering the rails and a boat on the rails.

4. The lift for elevating a boat according to claim 3 wherein said lifting rail is sufficiently buoyant to float in water.

5. The lift for elevating a boat according to claim 3 wherein said lifting rail in a lowered position abuts a cross bar defining the second axis to limit the extent of the lowered position of the lifting rail.

6. The lift for elevating a boat according to claim 3 wherein a hoist apparatus is carried by the base beam and has a cable encircling a pulley on the end of said means for mounting a second portion of the second lifting arm whereby shortening the cable will pivot the respective lifting arms for raising the rail and the boat thereon.

7. A lift for lifting a boat with a bow and a stern having a hull with an underside surface, said lift comprising:

a base;

a bow lifting arm having a predetermined length;

means mounting one portion of the bow lifting arm for pivoting movement relative to the base about a first axis;

a stern lifting arm having a length shorter than the length of the bow lifting arm;

means mounting one portion of the stern lifting arm for pivoting movement relative to the base about a second axis that is spaced from and parallel to the first axis;

a lifting rail for bearing on the underside surface of the hull; and means for pivotally connecting the lifting rail to the bow and stern lifting arms for pivoting movement about respective third and a fourth axes which axes are parallel to each other and are parallel to the first and second axes, the spacing between the third and fourth axes being less than the spacing between the first and second axes so that with a plane containing the first and second axes having a horizontal orientation, the boat situated on said lifting rail is tilted from the bow toward the stern and upon pivoting the bow and stern lifting arms about said first and second axes the lifting rail can be selectively raised and lowered relative to the base.

8. The combination according to claim 7 wherein the base is supported on a supporting surface and assumes a disposition relative to the supporting surface and means are provided on the base for varying the orientation of said base relative to the supporting surface on which said lift and boat are supported.

9. The combination according to claim 7 wherein there is an additional lifting rail spaced from the first claimed lifting rail, and the first claimed and additional lifting rails cooperatively support the boat above the base.

10. The combination according to claim 7 wherein said lifting rail is sufficiently buoyant to float in water in a semi-submerged position.

11. The combination according to claim 7 wherein said lifting rail has a flat surface that bears on the underside of the boat and the flat surface is non-parallel to the common plane of the first and second axes.

12. A lift for a marine craft having a bull with an underside surface, said lift comprising:

a base having a pair of parallel spaced apart beams joined together by a pair of cross bars each having opposite each portions;

a first pair of lifting arms;

means mounting one portion of the first pair of lifting arms to the opposite end portions of one of the cross bars for pivoting movement about a first axis defined by the one cross bar;

a second pair of lifting arms;

means mounting one portion of the second pair of lifting arms to the opposite end portions of the other of the cross bars for pivoting movement about a second axis defined by the other cross bar which second axis is spaced from and parallel to the first axis;

a pair of lifting rails for bearing on the underside surface of the hull; and means for pivotally connecting the lifting rails to the first pair and second pair of lifting arms for pivoting movement about a third and a fourth axis which third and fourth axes are parallel to each other and are parallel to the first and second axes, said first pair of lifting arms having a length that is longer than the length of the second pair of lifting arms, and a plane within which the first and third axes resides is nonparallel to a plane within which the second and fourth axes reside, whereby with the first and second axes lying in a horizontal plane, the craft on said lifting rails and the lifting rails are in a non-horizontal orientation and whereby pivoting the first pair and second pair of lifting arms about said first and second axes will raise and lower the lifting rails relative to the base.

13. A lift for a marine craft having a hull with an underside surface, said lift comprising:

a base having a pair of parallel spaced apart beams jointed together by a pair of cross bars;

a first pair of lifting arms;

means mounting one portion of the first pair of lifting arms to the opposite end portions of one of the cross bars for pivoting movement about a first axis of the one cross bar;

a second pair of lifting arms;

means mounting one portion of the second pair of lifting arms to the opposite end portions of the other of the cross bars for pivoting movement about a second axis defined by the other cross bar that is spaced from and parallel to the first axis;

a pair of lifting rails for bearing on the underside surface of the hull; and means for pivotally connecting the lifting rails to the first pair and second pair of lifting arms for pivoting movement about a third and a fourth axis which third and fourth axes are parallel to each other and are parallel to the first and second axes, said first pair of lifting arms having a length that is longer than the length of the second pair of lifting arms whereby with the first and second axes lying a horizontal plane, the craft on said lifting rails is in a non-horizontal orientation and whereby pivoting the first and second pairs of lifting arms about said first and second axes will raise and lower the lifting rails relative to the base, wherein the lengths of the lifting rails between the third and fourth axes are less than the lengths of the beams between the first and second axes so that the plane of the third and fourth axes is at an angle with the plane of the first and second axes to facilitate lifting the craft initially from the water.

14. The lift according to claim 13 wherein a winch is supported on a support on the base and includes a cable connected to a cross bar defining the fourth axis whereby cranking the winch pivots the lifting arms to raise the lifting rails and craft.

15. The lift according to claim 13 wherein the lifting rails contact the cross bar defining the second axis when in the down position of the lift whereby due to the differences in lengths of the first and second pairs of lifting arms and the differences in lengths of the beams and rails, the third and fourth pivot axes will be positioned for maximum lift.

16. A lift for a marine craft having a hull with an underside surface, said lift comprising:

a base having a pair of parallel spaced apart beams joined together by first and second spaced apart and parallel cross bars;

a first pair of lifting arms having a predetermined length;

means mounting one portion of the first pair of lifting arms to the opposite end portions of one of the cross bars for pivoting movement about an axis of said first cross bar;

a second pair of lifting arms having a predetermined length;

means mounting one portion of the second pair of lifting arms to the opposite end portions of the second cross bar for pivoting movement about an axis of the second cross bar that is spaced from and parallel to the axis of the first cross bar;

a pair of lifting rails for bearing on the underside surface of the hull;

means for pivotally connecting the lifting rails to the first pair and second pair of lifting arms for pivoting movement about a third and a fourth axis which third and fourth axes are parallel to each other and are parallel to the first and second cross bars, whereby with the first and second cross bars lying in a horizontal plane, the craft on said lifting rails is in a non-horizontal orientation;

the lengths of the lifting rails between the third and fourth axes are less than the lengths of the beams between the first and second axes whereby a plane defined by the third and fourth axes is at an angle to a plane defined by the first and second axes to facilitate draining of a craft on the rails and to facilitate lifting the craft from the water; and means for pivoting the first and second pairs of lifting arms about the axes of said first and second cross bars for raising and lowering the lifting rails and craft relative to the base.

17. The lift according to claim 16 wherein said third axis is defined by a third cross bar and said fourth axis is defined by a fourth cross bar and wherein said means for pivoting the first and second pairs of lifting arms comprises a winch operatively connected with said fourth cross bar.

18. A lift for a marine craft having a hull with an underside surface, said lift comprising:

a base having a pair of parallel spaced apart beams joined together by first and second spaced apart and parallel cross bars, each said cross bar having opposite end portions and an axis;

a first pair of lifting arms having a predetermined length;

means mounting one portion of the first pair of lifting arms to the opposite end portions of the first cross bar for pivoting movement about the axis of said first cross bar;

a second pair of lifting arms having a predetermined length shorter than the first pair of lifting arms;

means mounting one portion of the second pair of lifting arms to the opposite end portions of the second cross bar for pivoting movement about a second axis of the second cross bar that is spaced from and parallel to the axis of the first cross bar;

a pair of lifting rails for bearing on the underside surface of the hull;

means for pivotally connecting the lifting rails to the first pair and second pair of lifting arms for pivoting movement about a third and a fourth axis which third and fourth axes are parallel to each other and are parallel to the first and second cross bars, whereby with the first and second cross bars lying in a horizontal plane, the craft on said lifting rails is in a non-horizontal orientation; and means for pivoting the first and second pairs of lifting arms about the axes of said first and second cross bars for raising and lowering the lifting rails and craft relative to the base, wherein said third axis is defined by a third cross bar, said fourth axis is defined by a fourth cross bar and said means for pivoting the first and second pairs of lifting arms comprises a winch operatively connected with said fourth cross bar, wherein the length of the lifting rails between the third and fourth cross bars is less than the length of the beams between the first and second cross bars so that the plane of the third and fourth cross bars is at an angle with the plane of the first and second cross bars to facilitate lifting and craft initially from the water.

19. The lift according to claim 18 wherein said winch is carried by a support on the base and includes a cable connected to said fourth cross bar whereby cranking the winch pivots the lifting arms to raise the lifting rails and craft.

20. The lift according to claim 18 wherein the lifting rails contact the cross bar defining the second axis when in the down position of the lift whereby due to the differences in lengths of the first and second pairs of lifting arms and the differences in lengths of the beams and rails, the third and fourth pivot axes will be positioned for maximum lift.

21. A lift for elevating a boat relative to a support surface, said lift comprising:

an elongate base beam;

means for supporting the base beam on the support surface;

a first lifting arm;

means mounting one portion of the first lifting arm for pivoting movement relative to the base beam about a first axis that is transverse to the length of the base beam;

a second lifting arm;

means mounting one portion of the second lifting arm for pivoting movement relative to the base beam about a second axis that is parallel to said first axis and spaced lengthwise of the base beam from the first axis;

a lifting rail having a boat engaging surface;

means mounting a second portion of the first lifting arm to the lifting rail for pivoting movement relative to the lifting rail about a third axis that is parallel to and spaced from said second axis;

means mounting a second portion of the second lifting arm to the lifting rail for pivoting movement relative to the lifting rail about a fourth axis that is parallel to and spaced from said first axis, the spacing between the first and third axes being greater than the spacing between the second and fourth axes, whereby with a common plane within which the first and second axes reside horizontally oriented, the boat engaging surface is inclined so that a boat placed thereon will be in a tilted position;

cross bar means extending through said lifting rail and having an axis coincident with the fourth axis; and means for selectively exerting a force on said cross bar means to thereby pivot the second and the first lifting arms about the second and first axes and thereby raise and lower the lifting rail.

22. The lift according to claim 21 wherein said first and second lifting arms, the base beam and the lifting rail are interconnected so that a plane within which the first and third axes reside is nonparallel to a plane within which the second and fourth axes reside.

* * * * *